United States Patent [19]

Gerritsen

[11] 4,401,917

[45] Aug. 30, 1983

[54] COLOR DISPLAY TUBE INCLUDING CYLINDRICAL DIPOLE CORRECTION MAGNETS

[75] Inventor: Jan Gerritsen, Eindhoven, Netherlands

[73] Assignee: U.S. Philips Corporation, New York, N.Y.

[21] Appl. No.: 190,148

[22] Filed: Sep. 24, 1980

[30] Foreign Application Priority Data

Oct. 19, 1979 [NL] Netherlands ..... 7907717

[51] Int. Cl.[3] ..... H01J 29/56; H01J 29/76

[52] U.S. Cl. ..... 313/413; 313/440; 313/442; 335/210; 335/212

[58] Field of Search ..... 313/433, 437, 440, 442, 313/413; 335/212, 210

[56] References Cited

U.S. PATENT DOCUMENTS

| | | | |
|---|---|---|---|
| 2,455,676 | 12/1948 | Hillier | 313/443 |
| 2,935,635 | 5/1960 | Boothroyd et al. | 313/440 |
| 3,020,434 | 2/1962 | Bloomsburgh | 313/440 |

FOREIGN PATENT DOCUMENTS

| | | | |
|---|---|---|---|
| 678519 | 1/1964 | Canada | 313/442 |
| 1107348 | 5/1961 | Fed. Rep. of Germany | 313/442 |

*Primary Examiner*—Palmer C. Demeo

*Attorney, Agent, or Firm*—Thomas A. Briody; William J. Streeter

[57] ABSTRACT

If in a device for displaying colored pictures comprising a color display tube of the "in-line" type, which comprises magnetized means for maintaining a static magnetic multipole magnetic field near the output of the electron gun system for carrying out static beam corrections, a correction magnet is provided outside the neck near the output of the electron gun system and near at least one outermost electron beam, which magnet forms a magnetic dipole and is intersected by the said plane and which correction magnet is small with respect to its distance to said electron beam, it is possible afterwards to provide small corrections in the horizontal static convergence.

9 Claims, 9 Drawing Figures

COLOR DISPLAY TUBE INCLUDING CYLINDRICAL DIPOLE CORRECTION MAGNETS

The invention relates to a device for displaying coloured pictures, comprising a colour display tube having magnetized means for maintaining a static magnetic multipole field near the output of the in-line electron gun system for carrying out static beam corrections, and also having a system of deflection coils around the neck-cone transition of the tube envelope to deflect the electron beams over the display screen in two mutually perpendicular directions.

BACKGROUND OF THE INVENTION

Such a device is known from the article "30-AX Self-aligning 110° in line colour t.v. display" in Electronic Components and Applications Vol. 1, No. 2, February 1979. The magnetized means for maintaining a static magnetic multi-pole field near the output of the electron gun system consist in the device described in this article of a thin magnetized ring of a magnetic half-hard material, which ring is provided in the end of the gun. Dependent on the occurring convergence, colour purity and frame defects, the ring in the finished tube is magnetized to form a multipole (a combination of 2, 4 and 6 pole fields), so that the errors are corrected, as is described elaborately in U.S. Pat. No. 4,220,897 which may be considered to be incorporated herein by reference. Although in principle this described device forms a completely corrected system, it nevertheless appears in practice that small static and dynamic convergence errors occur during the operation of the devices. These errors may be the result, for example, of errors during the magnetization of the ring or of the use of other operating voltages during operation of the display tube. Small errors in the horizontal static convergence are intensified upon horizontal deflection and may adversely cooperate with the dynamic convergence errors of the coil.

OBJECT OF THE INVENTION

It is therefore an object of the invention to provide a simple auxiliary means by means of which small errors in the horizontal static convergence in a tube with magnetized means for maintaining a static magnetic multipole field can be removed so that the magnetized means in the colour display tube will not be magnetized again.

SUMMARY OF THE INVENTION

According to the invention, a device of the kind mentioned in the opening paragraph is characterized in that a correction magnet is provided outside the neck near the output of the electron gun system and near at least one outermost electron beam, which magnet forms a magnetic dipole and is intersected by the plane of the electron beams, and which correction magnet is small as compared with its distance to said electron beam. When the dimensions of the magnet are taken to be small in relation to the distance to the beams, the influencing in a point of the beams is inversely proportional to the third power of the distance to the beams. The central electron beam is thus considerably much less influenced by the magnetic field than the adjacent outermost electron beam. The farthest remote electron beam is even less influenced.

The dimension of the magnet which is determinative of the distance between the poles is preferably at most $\frac{1}{3}$ of the smallest distance between the magnet and the central path of the adjacent electron beam, because in that case the influence on the central electron beam is already very small.

Since a magnet can be constructed in many shapes, it is often difficult to accurately fix the distance between the poles of the correction magnet. In the case of a dipole, however, one dimension of the magnet is determinative of the distance between the poles. In a bar magnet, for example, the ends of which form the north and south poles of the magnet, the length of the bar is the dimension which is determinative of the distance between the poles.

A preferred embodiment of the device in accordance with the invention is characterized in that the correction magnet is a diametrically magnetized cylindrical bar magnet in which the distance between the poles is determined by the diameter of the bar magnet, which bar magnet is situated with its cylinder axis substantially perpendicular to the central paths and in the said plane through the central paths. The diameter of the magnet is, for example, 2.5 mm and the distance to the central path of the adjacent outermost electron beam is, for example, 12 mm and to the central electron beam is 21 mm. The influence on the central electron beam in that case is only approximately 25% on the influence of the outermost electron beam. It is possible to choose the strength of the dipole so that the desired correction is reached. Preferably, however, a standard dipole correction magnet is used which is provided in a holder so as to be rotatable about an axis substantially perpendicular to the connection line between the poles. By rotating the dipole the desired influence on the electron beam can be adjusted. The influence of the magnetic dipole is maximum when the dipole and hence the field lines of the dipole are perpendicular to the central path of the electron beam and substantially zero in a dipole which is directed parallel to the electron beam.

The connection of the correction magnet to the colour display tube can be done in a number of ways. For example, it is possible to connect the magnet to the clamping band with which the system of deflection coils is clamped around the neck of the colour display tube.

It is also possible to connect the correction magnet in or on a holder which is clamped to the housing of the system of deflection coils in some way or another. Another possibility is to provide a recess in the housing of the system of deflection coils in which the magnet is connected.

The electron gun system consists of a part for generating the electron beams succeeded by one or a few electrostatic lenses for focusing the beams on the display screen. The three electron beams may have a number of lens electrodes in common. In that case we have an integrated electron gun. The last lens of the electron gun system is sometimes termed focus lens both in integrated and in non-integrated electron guns. The dipole magnet is preferably placed substantially in the plane of said focus lens of the electron gun system which focuses the adjacent outermost electron beam on the display screen.

Such small correction magnets as used for the invention can be manufactured particularly readily from barium ferrite ($Ba\ Fe_{12}O_9$) with added thereto 10 to 15% by weight of thermoplastic material, for example, Ferroxdure p40 (F) and Feroxdure p30 (see Philips Data Handbook, Electronic components and materials, Components and Materials, Part 4b, February 1979, pp. 57–63).

BRIEF DESCRIPTION OF THE DRAWINGS

The invention will now be described in greater detail, by way of example, with reference to the drawings, in which.

DETAILED DESCRIPTION OF THE PREFERRED EMBODIMENTS

Figure 1:
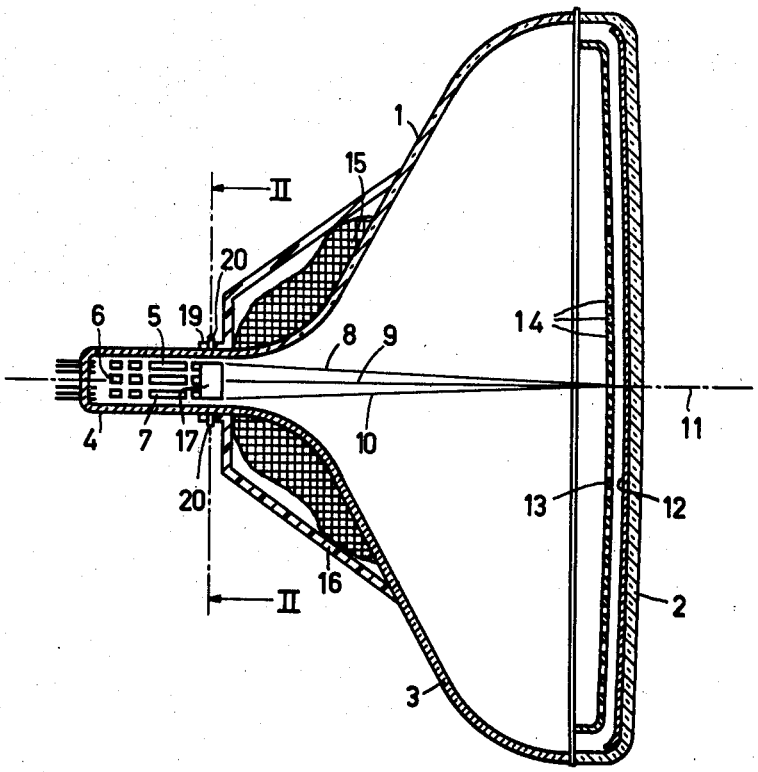
FIG. 1 is a sectional view of a device according to the invention.
Figure 2:
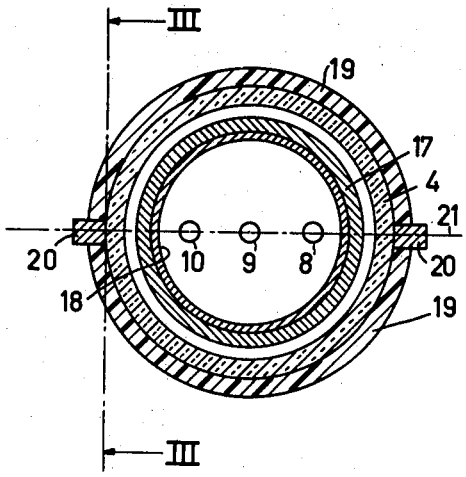
FIG. 2 is a sectional view taken on the line II—II of FIG. 1.

FIG. 1 is a diagrammatic sectional view of a device for displaying coloured pictures. The device comprises a colour display tube 1 having a glass envelope which is composed of a display window 2, a cone 3 and a neck 4. Three electron guns 5, 6 and 7 in the neck 4 generate the electron beams 8, 9 and 10, respectively. The electron beams are situated with their longitudinal axes in one plane, the plane of the drawing, as well as the central paths of the generated electron beams 8, 9 and 10 prior to the deflection. The axis of the central electron gun, the central path (or centre line) of the central electron beam 9 and the tube axis 11 substantially coincide. The outermost electron guns and electron beams 8 and 10 are situated symmetrically with respect to the central one. On the inside of the display window 2 is provided a display screen 12 which in a colour display tube is usually composed of a large number of phosphor stripes or dots. Before the said display screen 12 is provided a colour selection electrode 13 consisting of a metal plate having a very large number of apertures 14. Since the three generated electron beams enclose a small angle with each other and fall through the apertures on the display screen, each electron beam is associated with phosphor regions of one colour. In order to obtain a good display, the three electron beams must converge in the centre of the display screen and also after deflection. This is termed the static and dynamic convergence, respectively. The deflection of the electron beams over the display screen is done by means of self-converging deflection coils 15 which are provided in a housing 16 around the neck-cone transition. After the manufacture of the tube the errors in the static convergence, the colour purity and the frame are corrected by magnetizing a ring 18 around the electron beams of magnetic half hard material as a multipole. This is described elaborately in the already mentioned U.S. Pat. No. 4,220,897. This ring 18 is provided in electrode 17 which the three electron guns have in common, as is shown in FIG. 2. By using, for example, other operating conditions when operating the display tube, small errors in the convergence of the electron beams may nevertheless occur.

By providing according to the invention one or two small dipole correction magnets 20 near the outermost electron beam(s) it is possible to mitigate small errors in the horizontal convergence without remagnetisation of the ring 18 being necessary. The influence of the correction magnet is substantially restricted to the adjacent electron beam. Because the magnet (the distance between the poles) is small relative to the distance to the electron beam, the force F which acts on the electron beam is inversely proportional to $1/r^3$, hence $$F \alpha 1/r^3 \quad (1)$$

When, for example, the magnet is 21 mm remote from the central path of the central electron beam and 12 mm from the adjacent electron beam, then the force in a point of the central path of the central electron beam is approximately 20% of the force in a point of the central beam of the adjacent outermost electron beam. Because the beams are influenced over a length of a few centimeters, the overall influence on the central electron beam is approximately 25% of the influence on the adjacent outermost electron beam. The influence on the farthest remote outermost electron beam is still much smaller and is approximately 10%. The small dipole correction magnets thus make it possible to provide small changes in the direction of one or two outermost electron beams at will.

The correction magnet may be, for example, an axially magnetized bar magnet which, dependent on the desired beam influencing, has a given strength and may be selected from an ordered store of magnets of different strength.

Figure 3:
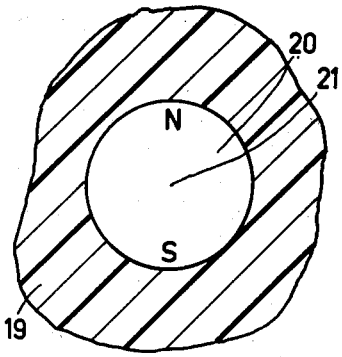
FIG. 3 is a sectional view taken on the line III—III of FIG. 2.

However, the correction magnet is preferably a diametrically magnetized cylindrical bar magnet, which bar magnet is situated with its cylinder axis 21 in the plane through the central path of the electron beams 8, 9 and 10, which is shown in FIGS. 2 and 3. By rotation about the axis 21, the magnet is adjusted so that the desired influence on the beam is reached.

The magnets are preferably situated in the plane of the focus lens of the electron beam which they are to influence. This is usually a plane situated between the last two electrodes of the electron gun.

The influencing of the electron beams in a vertical direction in a rotated or oblique magnet is very small and has proved to be not disturbing.

Figure 4:
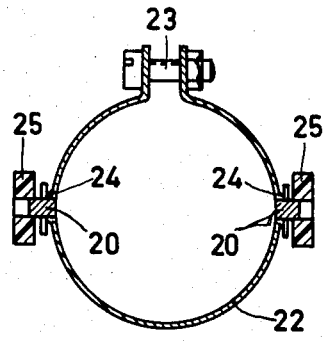
FIGS. 4 to 9 show in a number of sectional views and an elevational view how the correction magnets may be connected to the device.

The correction magnets can be connected to the colour display tube in a very large number of ways. In FIGS. 1 and 2, for example, it is shown how the correction magnets can be provided in recesses in the housing of the system of deflection coils. In colour display tubes the deflection coil system is often clamped around the neck of the envelope by means of a clamping band. FIG. 4 shows such a clamping band consisting of a bent strip of metal 22 which is clamped around the neck by means of a screw 23. The correction magnets 20 are provided in apertures 24 in the clamping band and are provided with adjusting buttons 25.

Figure 5:
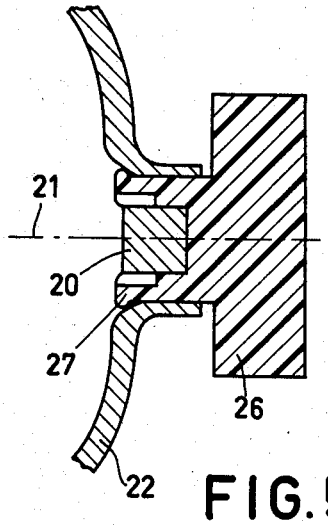
Figure 6:
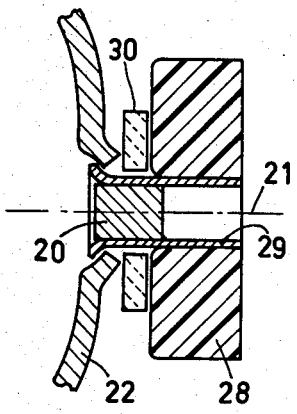

FIGS. 5 and 6 are sectional views of two possible ways in which the correction magnets can be connected to the clamping band.

The magnet 20 in FIG. 5 is provided in the button 26 which is connected in an aperture in the clamping band 22 and is locked by means of a ridge 27.

Figure 7:
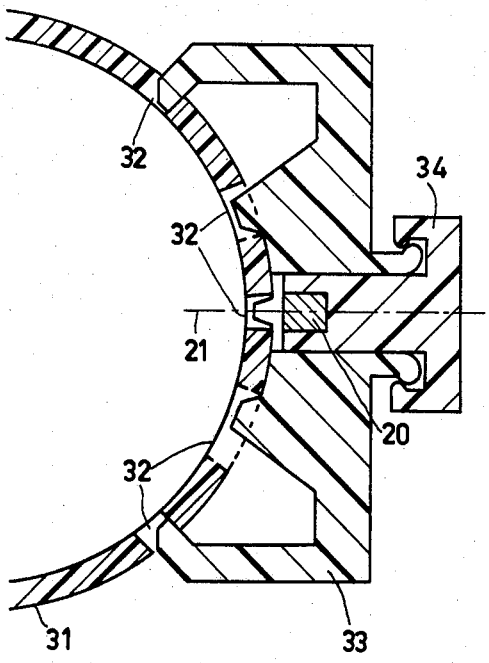
Figure 8:
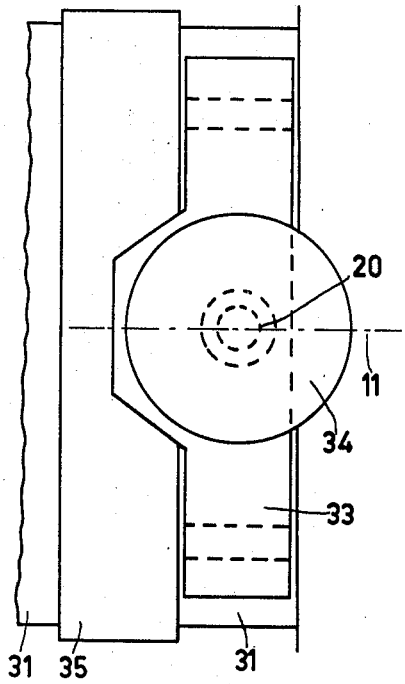

FIG. 6 shows a magnet 20 which is connected in a tubular rivet 29 which is connected in the button 28. The tubular rivet 29 is rotatable in an aperture in the clamping band 22. Between the button 28 and the clamping band a rubber ring 30 is provided. FIG. 7 is a sectional view of another way of connecting. The part 31 of the housing 6 of the system of deflection coils present around the neck is provided with a number of apertures 32. In these apertures is clamped a holder 33 in which the magnet 20 is provided so as to be rotatable in the button 34. FIG. 8 is an elevation of the construction shown in FIG. 7. A clamping band 35 is provided around the part 31.

Figure 9:
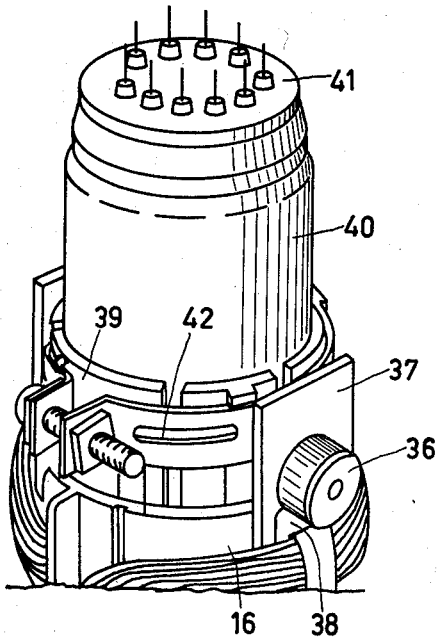

FIG. 9 shows in an elevation a correction magnet which is connected to the housing 16 of the system of deflection coils by means of a dovetail joint. The magnet (not visible) is connected to a plate 37 of non-ferromagnetic material so as to be rotatable in the manner as is shown in FIG. 5 or 6 in a button 36. The plate is slid on a projecting part 38 of the housing 16 (a dovetail joint). Around the end 39 of the housing 16 and neck 40 with connection pins 41 a clamping band 42 is provided as shown in FIG. 4 .

What is claimed is:

1. A color display tube comprising a glass envelope having a display window, a cone and a neck, a display screen on the inside of the display window and an in-line electron gun system in the neck, said in-line electron gun system generating three electron beams which converge on the display screen, the central electron beam having a central path that coincides substantially with the axis of the glass envelope and the two outermost electron beams being situated symmetrically with respect to said central beam, said envelope comprising a magnetized means for maintaining a static magnetic multipole field near the output of said in-line electron gun system for carrying out static beam corrections, a magnetizing means comprising a system of deflection coils around the neck-cone transition of the envelope for deflecting said electron beams over the display screen in two mutually perpendicular directions, and further comprising a correction magnet provided outside the neck of said envelope near the output of said in-line electron gun system and near at least one outermost electron beam, said correction magnet forming a magnetic dipole that is intersected by the plane of said electron beams, and said correction magnet being small with respect to its distance to said one outermost electron beam.

2. A device as claimed in claim 1, wherein the dimension of said correction magnet which is determinative of the distance between the poles of said correction magnet is at most $\frac{1}{3}$ of the smallest distance between said correction magnet and the central path of the adjacent electron beam.

3. A device as claimed in claim 2 wherein said correction magnet is a diametrically magnetized cylindrical bar magnet in which the distance between the poles is determined by the diameter of the bar magnet, which bar magnet is situated with its cylinder axis substantially perpendicular to the central paths of said electron beams and in the plane of said electron beams.

4. A device as claimed in claim 3, wherein said bar magnet has a diameter of approximately 2.5 mm and the distance from said bar magnet to the adjacent central path of the electron beam is approximately 12 mm.

5. A device as claimed in claim 1, wherein said correction magnet is positioned in a holder so as to be rotatable about an axis substantially perpendicular to the connection line between the poles.

6. A device as claimed in claim 1, wherein said correction magnet is connected to a clamping band by means of which the system of deflection coils is clamped around the neck of said tube.

7. A device as claimed in claim 1, wherein said correction magnet is secured in a holder which is clamped to the housing of the system of deflection coils.

8. A device as claimed in claim 1, wherein said correction magnet is situated substantially in the plane of the focusing lens of the in-line electron gun system, which focusing lens focuses the adjacent outermost electron beam on the display screen.

9. A device as claimed in claim 1, wherein said correction magnet consists of barium ferrite ($BaFe_{12}O_{19}$) having added thereto 10 to 15% by weight of thermoplastic material.

* * * * *